US011982083B2

(12) United States Patent
Verraes

(10) Patent No.: US 11,982,083 B2
(45) Date of Patent: May 14, 2024

(54) WALL SYSTEM FOR COMPOSING A FLAT WALL AND CONSTRUCTION KIT APPLIED THEREBY

(71) Applicant: WOV, besloten vennootschap met beperkte aansprakelijkheid, De Pinte (BE)

(72) Inventor: Wolfgang Pol Jozef Verraes, De Pinte (BE)

(73) Assignee: WOV, BESLOTEN VENNOOTSCHAP MET BEPERKTE AANSPRAKELIJKHEID, De Pinte (BE)

( * ) Notice: Subject to any disclaimer, the term of this patent is extended or adjusted under 35 U.S.C. 154(b) by 0 days.

(21) Appl. No.: 17/767,272

(22) PCT Filed: Oct. 7, 2020

(86) PCT No.: PCT/IB2020/059405
§ 371 (c)(1),
(2) Date: Apr. 7, 2022

(87) PCT Pub. No.: WO2021/070073
PCT Pub. Date: Apr. 15, 2021

(65) Prior Publication Data

US 2022/0412079 A1 Dec. 29, 2022

(30) Foreign Application Priority Data

Oct. 8, 2019 (BE) ..... 2019/5660

(51) Int. Cl.
*E04B 2/70* (2006.01)
*E04C 2/14* (2006.01)
*E04C 2/40* (2006.01)

(52) U.S. Cl.
CPC ..... *E04B 2/703* (2013.01); *E04C 2/14* (2013.01); *E04C 2/40* (2013.01)

(58) Field of Classification Search
CPC ..... E04B 1/40; E04B 2/48; E04B 2/70; E04B 2/703; E04C 2/14; E04C 2/40
See application file for complete search history.

(56) References Cited

U.S. PATENT DOCUMENTS 1,944,237 A * 1/1934 Heineman ..... E04C 2/14 52/584.1
5,097,558 A * 3/1992 Accorsi ..... E01D 19/125 14/2.4

(Continued)

FOREIGN PATENT DOCUMENTS

BE 1021698 B1 1/2016
DE 4201816 A1 7/1993

(Continued)

OTHER PUBLICATIONS

International Search Report & Written Opinion to corresponding PCT Application No. PCT/IB2020/059405 dated Mar. 5, 2021.

*Primary Examiner* — Christine T Cajilig
(74) *Attorney, Agent, or Firm* — Dinsmore & Shohl LLP

(57) ABSTRACT

Wall system for composing a flat wall, in particular a wall, floor, ceiling, roof or the like, the wall system is composed of wooden beams which extend parallel to each other lengthways and the side edges of which are mounted opposite each other breadthways by means of anchoring elements which are mounted in or on the beams and which in mounted condition of the wall are kept apart at a fixed defined distance by means of spacers which extend through passages in the beams, said passages extending and connecting breadthways of the beams and in each other's extension, whereby the anchoring elements are anchored relative to the (Continued)

passages in an axial and radial direction as well as against rotating around the axial passage direction of the passages.

20 Claims, 8 Drawing Sheets

(56) References Cited

U.S. PATENT DOCUMENTS

| | | | | |
|---|---|---|---|---|
| 5,531,054 | A * | 7/1996 | Ramirez | E04H 9/14 52/95 |
| 2002/0014050 | A1* | 2/2002 | Van Der Heijden | E04B 2/08 52/223.7 |
| 2009/0133345 | A1* | 5/2009 | Wrightman | E04B 2/702 411/332 |
| 2015/0013240 | A1* | 1/2015 | Malakauskas | E04B 1/34869 52/79.9 |
| 2016/0153188 | A1* | 6/2016 | Verraes | E04C 2/12 52/264 |

FOREIGN PATENT DOCUMENTS

| | | | |
|---|---|---|---|
| EP | 0787866 | A1 | 8/1997 |
| GB | 2090886 | A | 7/1982 |

* cited by examiner

WALL SYSTEM FOR COMPOSING A FLAT WALL AND CONSTRUCTION KIT APPLIED THEREBY

CROSS-REFERENCE TO RELATED APPLICATIONS

The present application is the National Phase entry of International Patent Application No. PCT/IB2020/059405 filed Oct. 7, 2020, which claims priority to Belgium Patent Application No. 2019/5660 filed Oct. 8, 2019, the entire contents of both are hereby incorporated by reference into this application.

TECHNICAL FIELD

The present disclosure relates to a wall system for composing a flat wall.

In particular the present disclosure is intended to form a wall which must be form stable under the load for which the wall is intended.

BACKGROUND

Examples include walls of a building structure such as a floor, wall, ceiling, roof or the like of a building, but can also be applied for example for a table top or for temporary constructions such as for building booths, stages or other constructions.

From BE 1.021.698 and corresponding US2016/153188 a wall system is known which is composed of wooden beams which extend parallel to each other lengthways and the side edges of which are mounted against each other breadthways by intermediate pieces which are provided with a collar and which with their collar are mounted with a certain clearance between the side edges and which are connected to each other by spacers which are mounted in each other's extension through passages in the beams and which are screwed into the intermediate pieces and keep the intermediate pieces at a fixed distance from each other.

A problem that occurs with this wall system is that as the wood becomes dryer, the breadth of the beams decreases, such that the clearance between the beams becomes greater and the beams come loose relative to each other and thus provide less lateral support and stability. This is disadvantageous for the wall's strut rigidity, possibly causing for example such wall above a window to sag because under load it is subjected to compression and at the bottom is exposed to pull.

In the case of a strut wall which has to strut another transverse wall laterally, a big gust of wind on the transverse wall may cause the strut wall at the top to tilt. This lack of strut rigidity can be compensated by reinforcing the construction with metal beams, which makes the construction a lot more expensive.

Another problem is that a big enough collar is needed to be able to tension the wood, meaning that the beams must have a sufficient thickness, which in turn is disadvantageous for the required quantity of wood and the cost price per beam.

The collars need to have a minimum size to, for example, straighten a beam that warped due to tensioning of the spacers without the collar being pulled into the wood of the beam.

The intermediate pieces in the case of BE 1.021.698 can be provided with axially oriented teeth which cut into the wood in an axial direction when the spacers are tensioned to prevent the intermediate pieces from rotating along during the tensioning or disassembly.

However, these teeth do not prevent the beams from shifting laterally relative to each other on the spacers in case of drought, to the detriment of the strut rigidity.

In the event of reuse such as in the case of temporary wall constructions of a booth or the like, which are regularly disassembled and reassembled, the teeth do not always go into the same place, such that the passages are weakened along their outside perimeter and over time the rotating of said teeth cannot be prevented.

SUMMARY

The purpose of the present disclosure is to provide a solution to one or more of the aforementioned and other disadvantages.

To this end, the present disclosure relates to a wall system for composing a flat wall, in particular a wall, floor, ceiling, roof or the like, which is composed of wooden beams which extend parallel to each other lengthways and the side edges of which are mounted opposite each other breadthways by anchoring elements which are mounted in or on the beams and which are kept apart at a fixed defined distance by spacers which extend through passages in the beams, said passages extending and connecting breadthways of the beams and in each other's extension, whereby the anchoring elements are anchored relative to the passages in an axial and radial direction as well as against rotating around the axis of the passages.

Thus the wall is provided as it were with a metal reinforcement which extends perpendicular to the longitudinal direction of the beams in two or more rows.

In this way the relative position of the beams is fixed at the location of the anchoring elements which define fixed nodes with a calibrated fixed diagonal distance between the nodes. Indeed, the beams have the property of not substantially expanding lengthways, such that the longitudinal nodes of the beams do not move relative to each other, this in combination with the fixed distance of the spacers between the nodes in lateral direction.

The fixed diagonal distance between the nodes where the beams are kept by the anchoring elements provides for a better stability and strut rigidity.

According to a practical and simple to realise embodiment, the anchoring elements are screw-in sleeves which are screwed in the passages and the spacers are executed as rods which fit in the passages with their bodies in each other's extension and which are provided with a bore with internal thread at the rear end of the body and with a threaded rod with complementary thread at the front end, whereby in mounted condition the threaded rod at the front end of the rods is screwed through a screw-on sleeve into the thread at the rear end of a next rod on the opposite side of the screw-in sleeve.

In these embodiments the anchoring elements can be screwed into the passages beforehand, which, as is known in the event of a suitable choice of screw-in sleeves with a rough exterior thread, results in a wall-solid fixation in the wood against loosening and therefore also against axial movement in the passages.

In the event of a possible disassembly of such a wall, for example for reuse, the anchoring elements can stay where they are as they are so tightly fixed in the wood that they will not move when loosening the spacers again. The previous anchoring element does not turn with the loosening one after the other of the spacers. The previous anchoring element does not turn when the spacers are loosened one after the other.

The passages are therefore not damaged such that the wall system is suitable for disassembling and reassembling several times over.

Due to the fact that this wall system does not need a collar to tension the beams against each other, the beams and anchoring elements can also be made thinner, resulting in cost cuts.

The present disclosure also relates to a construction kit for a wall system according to any one of the embodiments above, whereby the construction kit is composed of:

- two or more wooden beams which are provided with passages breadthways;
- anchoring elements which are anchored in or on the beams relative to the passages or can be anchored in an axial and radial direction and are also anchored against rotating around the axial passage direction of the passages;
- spacers with a fixed length which fit in the passages to be able to connect the anchoring elements to each other with a fixed defined distance from each other.

BRIEF DESCRIPTION OF THE DRAWINGS

With the intention of better showing the characteristics of the present disclosure, embodiments of a wall system according to the present disclosure and an accompanying construction kit are described by way of an example without any limiting nature, with reference to the accompanying drawings, wherein.

DETAILED DESCRIPTION

Figure 1:
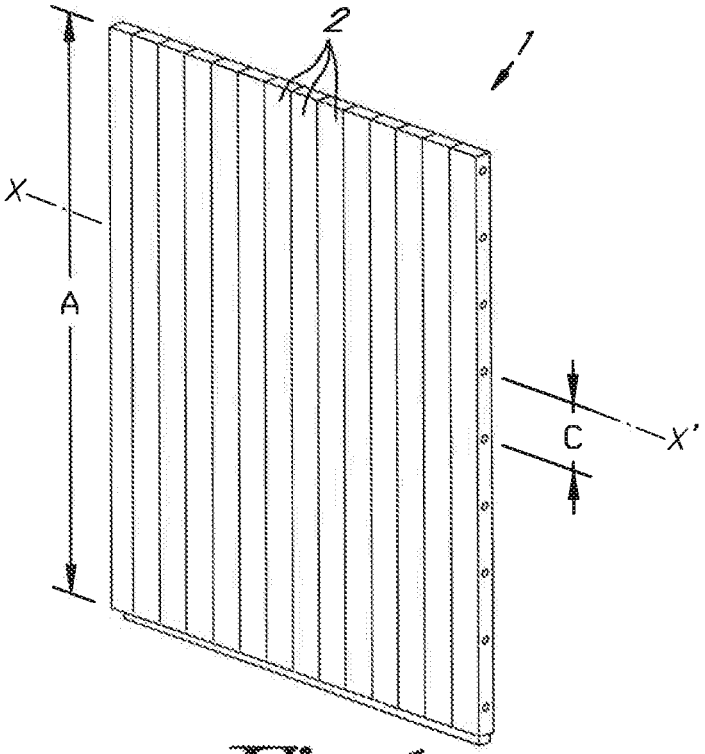
FIG. 1 schematically shows a perspective view of a wall system according to the present disclosure.
Figure 2:
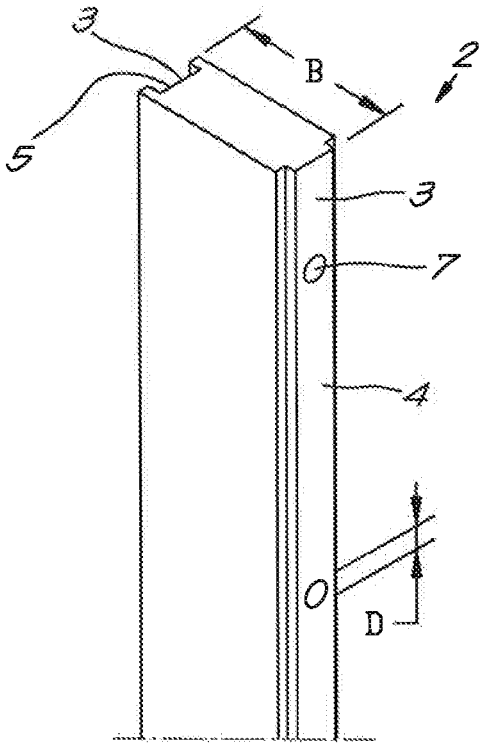
FIG. 2 shows a beam of the wall system of FIG. 1 on a larger scale.
Figure 3:
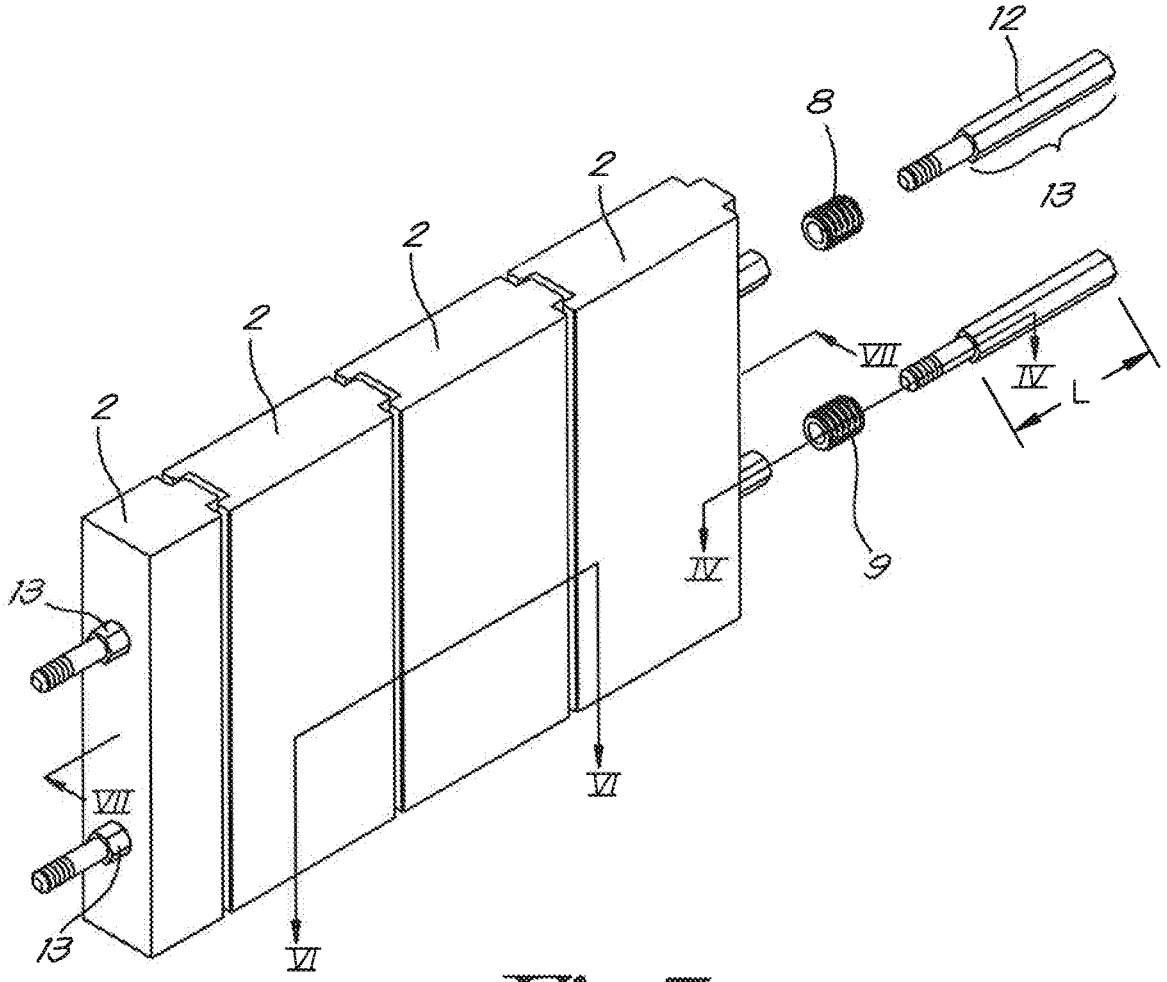
FIG. 3 shows the wall system of FIG. 1 during construction.
Figure 4:
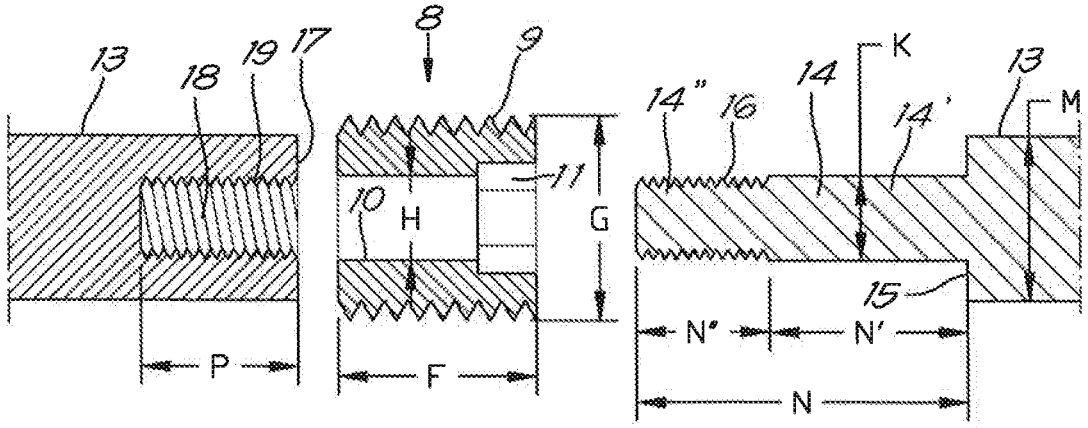
FIG. 4 shows a cross-section according to line IV-IV of some components of FIG. 3.

The flat wall 1 shown in FIGS. 1 and 2 is built with a wall system according to the present disclosure and is composed of parallel vertical wooden beams 2 with a length A and a breadth B and which are, for example, made such that they are dimensionally stable lengthways without significant expansion or shrinkage lengthways.

Figure 11:
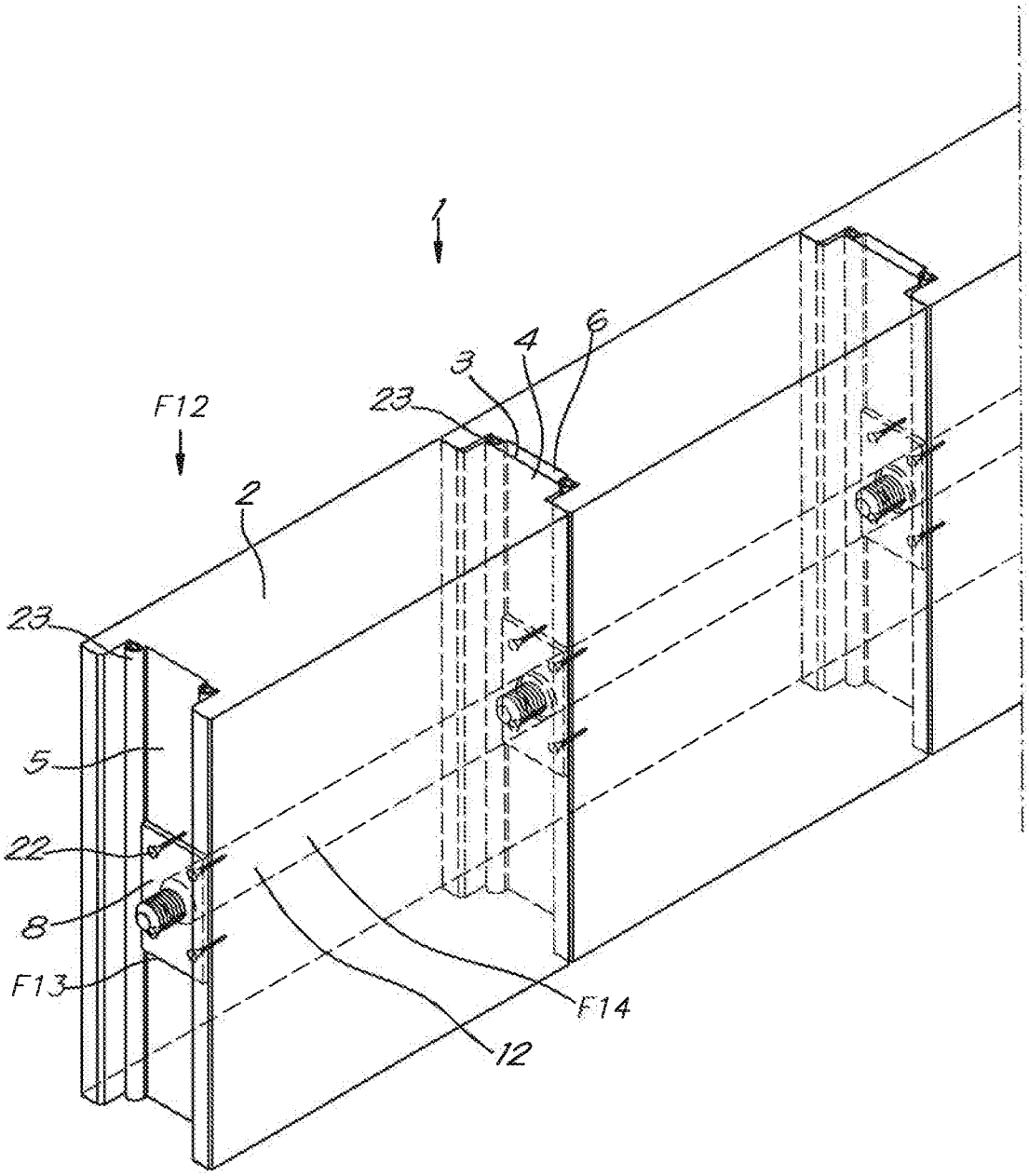
FIG. 11 shows a variant of a wall system according to the present disclosure.

In this case the beams 2 extend parallel to each other lengthways and their side edges 3 are mounted opposite each other breadthways, whereby these side edges 3 are provided with a tongue 4 and groove 5 with which the beams laterally fit into each other, possibly with a certain lateral clearance 6, as shown in FIG. 11, depending on the humidity of the surroundings.

The beams 2 are provided with passages 7 with a diameter D at a centre distance C from each other which extend over the breadth B of the beams 2 according to an axial passage direction X-X' and which in a mounted condition of the wall are located in each other's extension in two or more continuous transversal channels.

An anchoring element 8 is mounted in every passage 7 at a fixed depth E from the side edge 3 of the beams 2.

In the case of the FIGS. 3 to 6, the anchoring elements 8 are executed as a screw-in sleeve with length F provided with a rough exterior thread 9 with outer diameter G which is bigger than the inner diameter D of the passages 7 and a smooth inner wall 10 with inner diameter H.

In some embodiments, the anchoring elements 8 are premounted in the passages 7 by screwing them axially in the passages 7 with a powerful screwdriver, for example provided with an Allen key head which fits in a complementary non-round recess 11 in the inner wall 10 of the anchoring element 8.

The wall system is further provided with spacers 12 which are mounted across the passages 7 between the anchoring elements 8 to keep them at a fixed distance L and to fix them.

In this case, the spacers 12 are executed as rods with a body 13 with said length L and in this case a hexagonal cross-section with a defined circle, the diameter M of which is approximately equal to the inner diameter D of the passages 7.

The body 13 has a front end on which a threaded rod 14 is coaxially mounted with a diameter K which is approximately equal to the inner diameter H of the anchoring elements 8 and which is less than the diameter M of the defined circle of the body 13, this to form a front stop surface 15.

The threaded rod 14 has a length N which is divided into a cylindrical section 14' with length N' from the foot of the threaded rod 14 and a section 14" with length N" provided with fine thread 16 with an outer diameter equal to or less than the diameter K of the cylindrical section 14'.

The rear end of the body 13 is cut straight to form a rear stop surface 17 and is provided with an axial bore 18 with length P provided with thread 18 which is complementary to the thread 16 of the threaded rod 14, such that the threaded rod 14 can be screwed in the bore 17.

Figure 5:
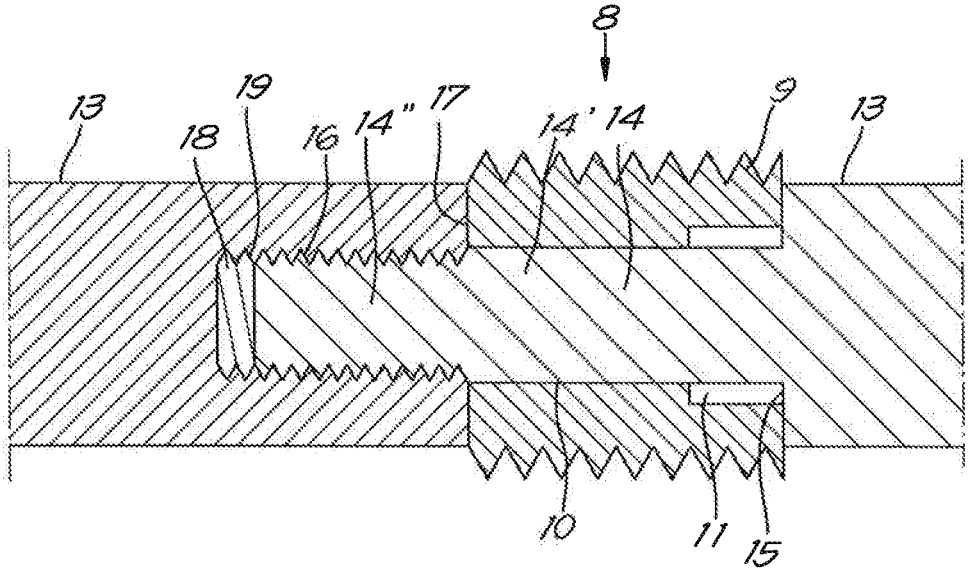
FIG. 5 shows the cross-section of FIG. 4 but with the components screwed into each other.

In some embodiments, the length N of the threaded rod 14 is less than the sum of the axial length F of the screw-in sleeve 8 and the length P of the bore 18 and the length N' of the smooth section 14' is equal to or less than the length F of the anchoring element 8, all this such that the threaded rod 14 can be screwed sufficiently deep through the anchoring element 8 in the bore 18 with clamping of an anchoring element 8 between the front stop surface 15 of the spacer 12 on one side and the rear stop surface 17 of the spacer 12 on the other side of the anchoring element 8 as shown in FIG. 5.

The dimensions of the hexagonal cross-section of the body 13 of the spacers are such that a standard key fits over the body to screw two spacers into each other with clamping of the anchoring element 8. Other solutions for the use of a screwing tool are evidently not excluded.

It is not excluded to apply a screw fitting between the spacers 12 and the anchoring elements 8 for which no tools are required, like in the case of a kind of a bayonet fitting wherein de parts of the bayonet fitting have to be turned for instance over half a turn in respect to each other.

Figure 6:
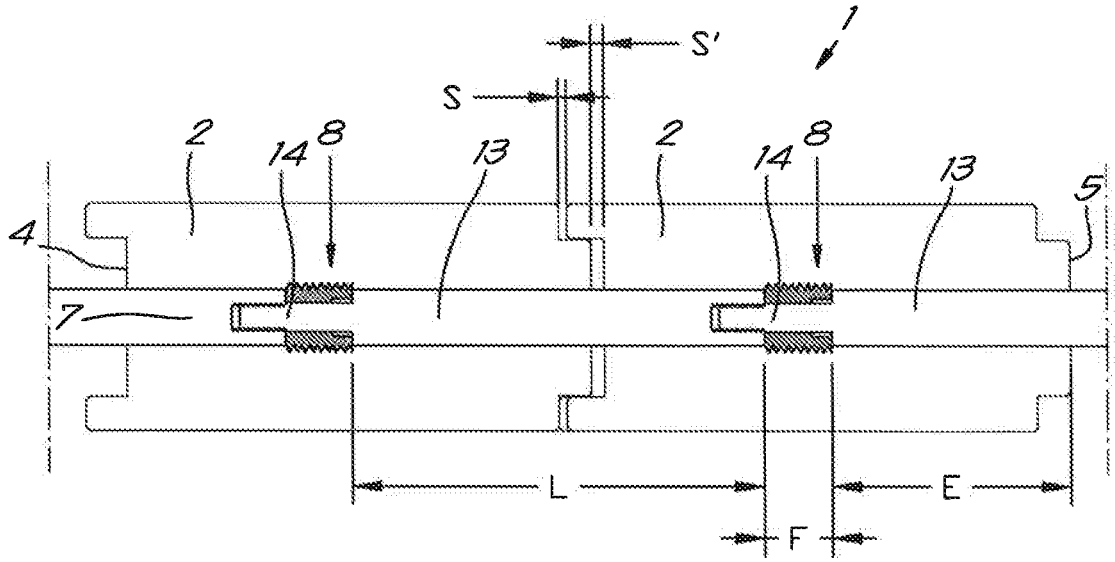
FIG. 6 shows a cross-section according to line VI-VI in FIG. 3.

FIG. 6 shows a situation whereby the side edges 3 of two identical beams 2 are mounted opposite each other with a wall system according to the present disclosure with a series of identical anchoring elements 8 and identical spacers 12.

Figure 7:
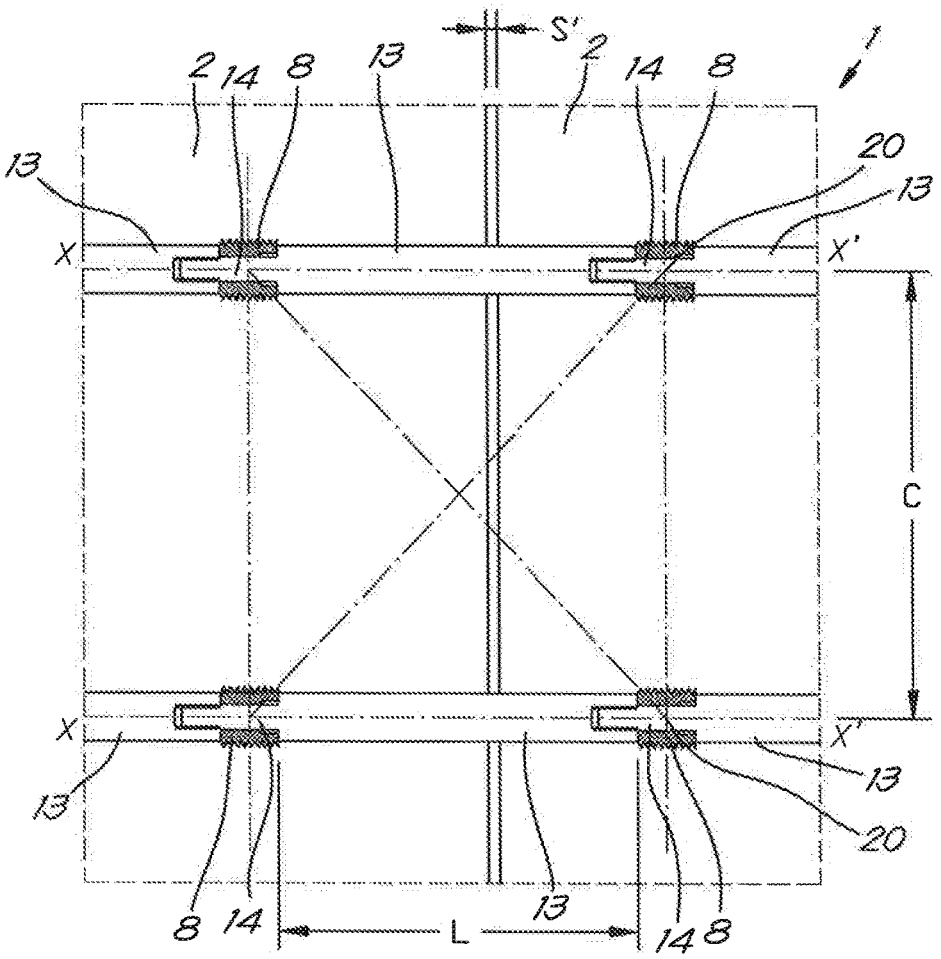
FIG. 7 shows a cross-section according to line VII-VII in FIG. 3.

The anchoring elements 8 lie with their centre on a regular rectangular node pattern with nodes 20 as shown in FIG. 7, this thanks to the fixed distance L between the spacers 8, the fixed length F of the anchoring elements 8 and the dimensional stability of the centre distance C between the passages 7 in the beams 2 due to the dimensional stability of the beams 2 lengthways.

The diagonal distance between the nodes 20 is therefore fixed, which ensures the strut rigidity of the wall system because the beams 2 are attached as it were to the nodes. The relative position of the beams 2 is therefore fixed, regardless of the swelling or shrinkage of the beams 2 breadthways B as a result of increasing or decreasing humidity.

The length L and F are chosen such that in the event of the highest wood humidity of the beams 2 and therefore the greatest swelling of the beams 2 breadthways B, a minimum clearance S and S' always remains between the beams, possibly taking into account the presence of a mounting bracket that may be present in the clearance between the beams 2. This length can depend on the thickness of the wood and the type of wood which does not necessarily have to be solid wood, but can also be laminated wood or plywood or another type of wood.

To disassemble the wall 1, the spacer 12 at one end of the wall 1 can be loosened, while the spacer 12 at the other end of the wall 1 is held to stop it rotating. It is always the first spacer 8 that comes loose without the anchoring elements 12 loosening and therefore without damaging the passages 7. The beams 2 with the premounted anchoring elements 8 can therefore be reused for a new wall.

The wall system according to the present disclosure is delivered on site as a modular construction kit with:

- a series of wooden beams 2 which breadthways B are provided with passages 7 and premounted anchoring elements 8 in the passages 7 which are anchored in the passages 7 in the beams 2;
- the necessary spacers 12 with a fixed length which can be fittingly slid and rotated in the passages 7.

Figure 8:
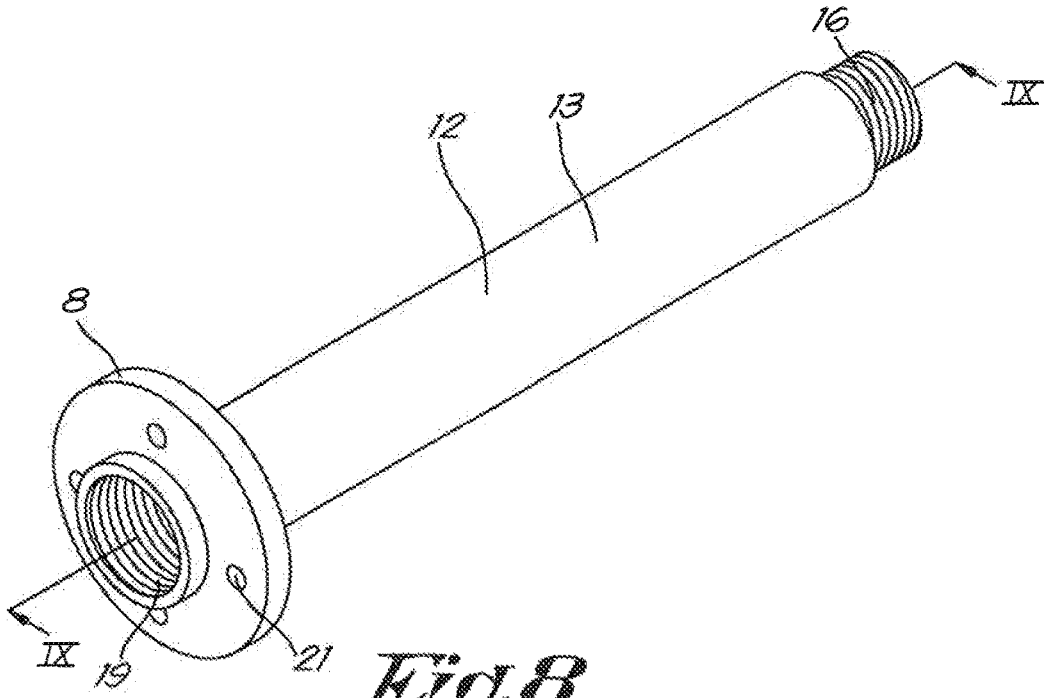
FIG. 8 shows a variant of a component of the wall system of FIG. 1.
Figure 9:
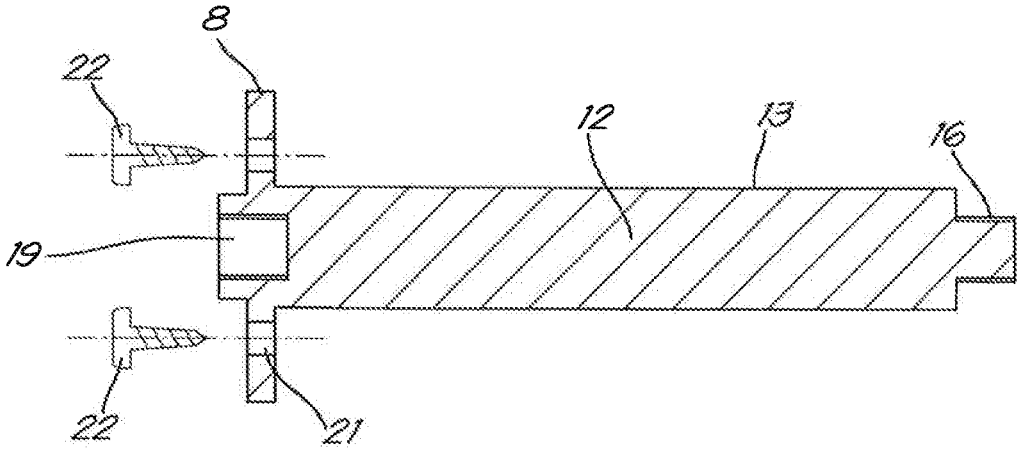
FIG. 9 shows a cross-section according to line IX-IX in FIG. 8.

FIGS. 8 and 9 show a variant of an anchoring element 8 and a spacer 12 made in one piece from metal or the like.

In this case the spacer 12 is executed as a rod or tube with at one end an exterior thread 16 and at the other end a complementary internal thread 19 and a pinion mounted on the tube which serves as anchoring element 8, for which purpose this pinion is provided with holes 21 to be able to screw the pinion against a side edge 3 of a beam 2 with screws 22 and therefore anchor it on the beam axially and against rotation.

In this case the anchoring elements in the construction kit will not be premounted on the beams 2.

Figure 10:
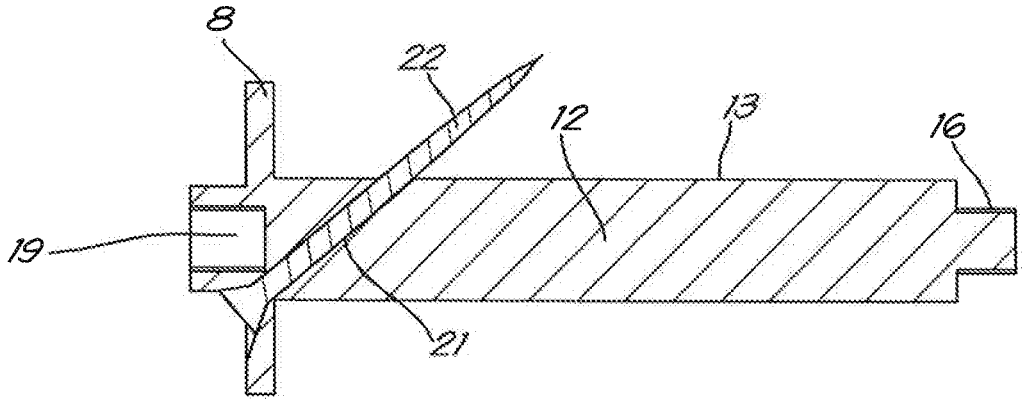
FIG. 10 shows a cross-section as in FIG. 9 but for an alternative embodiment.

FIG. 10 is variant of the embodiment represented in FIGS. 8 and 9, whereby in this case the body 13 of the spacer 12 is provided with a hole 21 in the form of a bore 21 at the extremity of the spacer 12 with the anchoring element 8, which bore 21 encloses an angle T with the axial centreline of the spacer 12 of for instance 40°.

The bore 21 is meant for anchoring the spacer 12 with its anchoring element 8 with regards the passages 7 in the beam 2 in axial and in rotational direction by a single screw 22 which is screwed in at an angle. That way a connection is realised that fulfils the requirements of a Eurocode connection.

It is clear that more than one such angled screw could be applied and whether or not in combination with screws 21 like in FIG. 9.

FIG. 11 shows yet another embodiment of a wall system 1 according to the present disclosure which is composed of beams 2 which are connected to each other with a lateral clearance 6 between the side edges 3 by anchoring elements 8 which are kept at a distance L from each other by spacers 12 which extend through passages 7 which connect the side edges 3.

Flexible compressible seals 23 are mounted between beams 2 which seal the gap between the beams 2 to stop wind and rain.

In this case the spacers 12 have a body 13 with a hexagonal cross-section and at one end are provided with a coaxial threaded rod 14 with exterior thread 16 and at the other end a coaxial bore 18 with corresponding internal thread 19.

Figure 12:
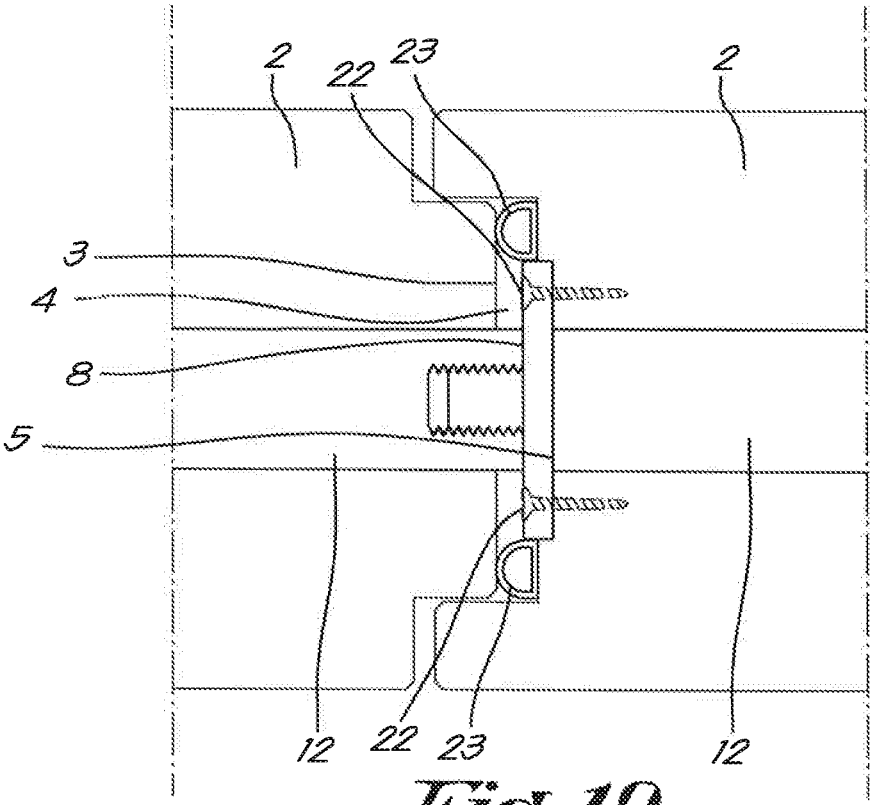
FIG. 12 shows a top view according to the arrow F12 in FIG. 11.
Figure 13:
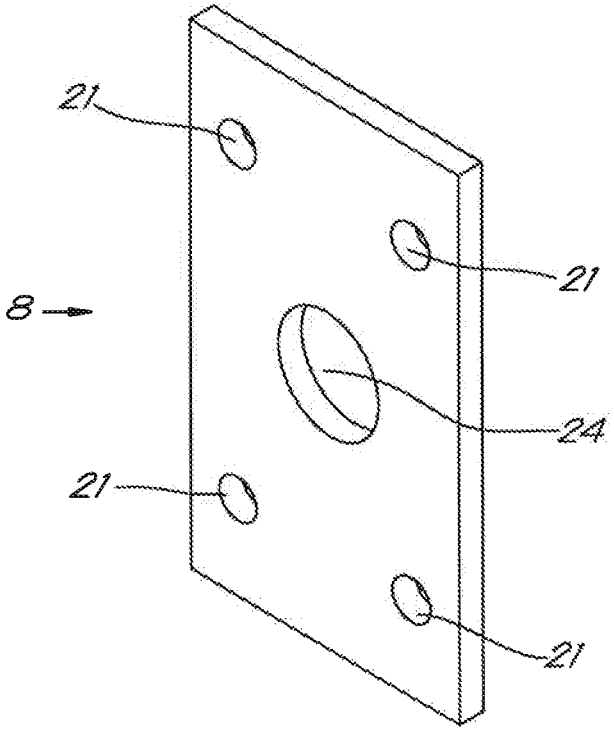
FIG. 13 shows the section indicated in FIG. 11 with F13.
Figure 14:
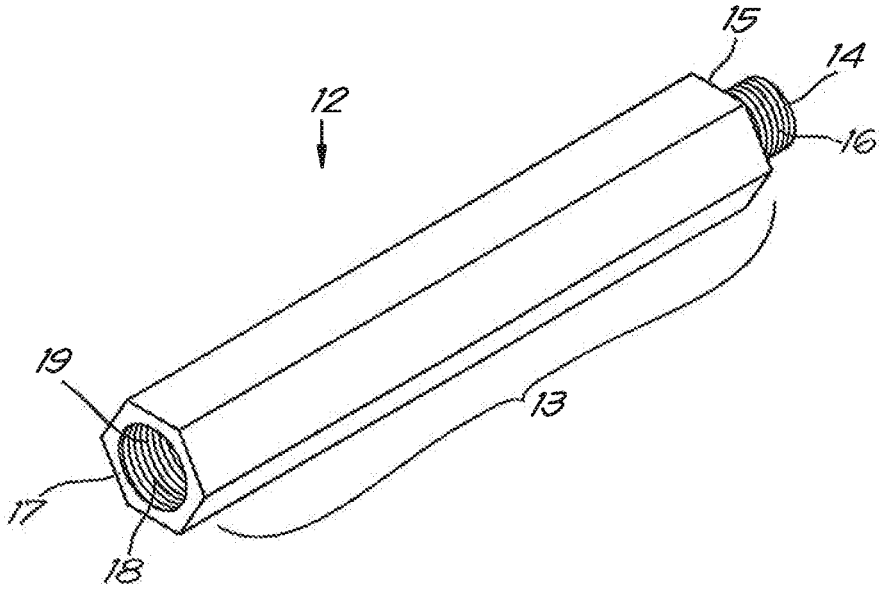
FIG. 14 shows the section indicated in FIG. 11 with F14.

In this case the anchoring elements 8 are formed by separate plates as shown in FIG. 12 with a central passage 24 for the threaded rod section 14 of the spacers 12 and holes 21 for screws 22 with which the plates can be screwed in the groove 5 as shown in FIG. 10.

Before mounting, the plates 8 are screwed in the grooves 5 of the beams 2 with the central passage 24 in line with the passages 7 in the beams 2.

Subsequently the beams 2 are mutually attached to each other one by one by the spacers 12 which are inserted with their threaded rod section 14 forward through a passage 7 in the last beam 2 and through the central passage 24 of the plate 8 of the last beam and subsequently are completely tightened with the threaded rod section 14 in the thread 19 of the bore 18 of the previous spacer 12.

The length of the body 13 of the spacers 8 determines said fixed distance L between the anchoring elements 8 whereby the body 13 is clamped with its stop surfaces 15 and 17 between two consecutive anchoring elements 8.

Instead of the plates being attached in the grooves 5 it is not excluded that the plates are mounted against the end of the tongues 4.

It is understood that the plates can be attached in any other way on the beams 2.

The present disclosure is not limited to the embodiments described as an example and shown in the drawings, but a wall system according to the present disclosure and accompanying construction kit can be realised in all kinds of forms and dimensions, without departing from the scope of the present disclosure.

The invention claimed is:

1. A wall system for composing a flat wall, the wall system is composed of wooden beams which extend parallel to each other lengthways with their side edges mounted opposite each other with a lateral clearance between them, the beams being mounted by anchoring elements which are mounted in or on the beams and which in a mounted condition of the wall are kept apart at a fixed defined distance by spacers which extend through passages in the beams, the passages extending and connecting breadthways of the beams and extending in an axial passage direction, whereby the anchoring elements are anchored relative to the passages in an axial and radial direction as well as against rotating around the axial passage direction of the passages, the anchoring elements defining fixed nodes of the beams with a fixed distance between the nodes.

2. The wall system according to claim 1, wherein the anchoring elements are screw-in sleeves which are screwed in the passages and the spacers are rods having bodies which fit in the passages and at a rear end of the body are provided with a bore with internal thread and at a front end are provided with a threaded rod with complementary thread, whereby in the mounted condition the spacers are screwed with the threaded rod at the front end through an anchoring element in the thread at the rear end of a subsequent spacer on the opposite side of the anchoring element.

3. The wall system according to claim 2, wherein the body of the spacers at the front end and at the rear end shows a stop surface between which each of the anchoring elements are clamped.

4. The wall system according to claim 3, wherein the stop surface at the front end is formed because the threaded rod has a smaller cross-section than the body of the spacer and that the stop surface at the rear end is formed because the body of the spacer has a perpendicular end surface.

5. The wall system according to claim 3, wherein the length of the body of the spacers between the stop surfaces is a fixed distance.

6. The wall system according to claim 5, wherein the body has a constant cross-section over the whole length and is fittingly slideable and rotatable in the passages.

7. The wall system according to claim 2, wherein at the front end of the body, the threaded rod has an outer diameter which is equal to or slightly less than the inner diameter of the anchoring element executed as a screw-in sleeve.

8. The wall system according to claim 2, wherein the length of the threaded rod is less than the sum of the axial length of the anchoring element executed as a screw–in sleeve and the axial length of the bore at the rear end of the rods.

9. The wall system according to claim 8, wherein the threaded rod over a certain length from the front stop surface is smooth with an outer diameter which is equal to or slightly less than the inner diameter of the anchoring element executed as a screw-in sleeve.

10. The wall system according to claim 8, wherein the length of the smooth section of the threaded rod is equal to or less than the axial length of the anchoring element.

11. The wall system according to claim 2, wherein the anchoring element is provided with means to screw it in a passage of the beam.

12. The wall system according to claim 2, wherein the spacers are provided with means to screw the rods into each other.

13. The wall system according to claim 12, wherein the body of the spacers are provided over the entire length or a section thereof with a non-round cross-section configured to be screwed by a screwing tool.

14. The wall system according to claim 1, wherein the anchoring elements in the passages are anchored at a fixed axial depth of a side edge of the beams.

15. The wall system according to claim 1, wherein the anchoring elements in or on the beams are premounted.

16. The wall system according to claim 1, wherein one anchoring element per beam is provided.

17. The wall system according to claim 1, wherein the anchoring elements and the spacers are made of metal.

18. A construction kit for a wall system according to claim 1, wherein the construction kit is composed of:

two or more wooden beams which breadthways are provided with passages;

anchoring elements which are anchored in or on the beams relative to the passages or can be anchored in an axial and radial direction and are also anchored against rotating around the axial passage direction (X-X') of the passages; and spacers with a fixed length which fit in the passages to be able to connect the anchoring elements to each other with a fixed defined distance from each other.

19. The wall system according to claim 2, wherein the anchoring element is provided with a non-rounded recess for receiving a screwing tool to screw the anchoring element in a passage of the beam.

20. The wall system according to claim 2, wherein at least part of a length of the spacers is provided with a non-rounded cross-section configured to screwed by a screwing tool to screw the rods into each other.

* * * * *